US009631356B2

(12) United States Patent
Nesbitt et al.

(10) Patent No.: US 9,631,356 B2
(45) Date of Patent: Apr. 25, 2017

(54) COMBINED SEWER OVERFLOW WARNING AND PREVENTION SYSTEM

(71) Applicant: GLOBALFOUNDRIES INC., Grand Cayman (KY)

(72) Inventors: Pamela A Nesbitt, Ridgefield, CT (US); Jake Palmer, Durham, NC (US); Donnie Smith, Jr., Raleigh, NC (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 819 days.

(21) Appl. No.: 13/874,446

(22) Filed: Apr. 30, 2013

(65) Prior Publication Data

US 2014/0324406 A1 Oct. 30, 2014

(51) Int. Cl.

| | |
|---|---|
| ***G06G 7/50*** | (2006.01) |
| ***E03F 3/00*** | (2006.01) |
| ***E03F 3/02*** | (2006.01) |
| *E03F 5/10* | (2006.01) |

(52) U.S. Cl.

CPC ..... *E03F 3/00* (2013.01); *E03F 3/02* (2013.01); *E03F 5/10* (2013.01); *E03F 2201/40* (2013.01)

(58) Field of Classification Search

CPC .... G05B 19/00; E03F 3/00; E03F 3/02; E03F 5/10; E03F 2201/40; G06G 7/50

USPC ..... 703/6, 9

See application file for complete search history.

(56) References Cited

U.S. PATENT DOCUMENTS

| | | | | |
|---|---|---|---|---|
| 7,039,565 | B1 * | 5/2006 | Jin | G06F 17/5004 703/2 |
| 7,792,126 | B1 | 9/2010 | Montestruque et al. | |
| 8,220,484 | B2 | 7/2012 | Howitt | |
| 2003/0236639 | A1 * | 12/2003 | Curry | G01F 1/002 702/45 |
| 2009/0250125 | A1 | 10/2009 | Howitt | |

(Continued)

OTHER PUBLICATIONS

IBM, IBM Intelligent Operations Center for Smarter Cities, Nov. 2012, IBM, pp. 1-15.*

(Continued)

*Primary Examiner* — Eunhee Kim

(74) *Attorney, Agent, or Firm* — Anthony Canale; Andrew M. Calderon; Roberts Mlotkowski Safran Cole & Calderon P.C.

(57) ABSTRACT

A monitoring and alert methodology ascertains conditions that may result in a combined sewer overflow (CSO) event. The method employs a semantic model of a combined sewer system that includes specification information describing the components of the combined sewer system. Sensors distributed throughout the components of the combined sewer system sense operating parameter information for those components. A monitoring and alerting (MA) information handling system (IHS) receives operating parameter information from the sensors. The MA IHS analyzes the operating parameter information received from the sensors together with the specification information in the semantic model of the combined sewer system to determine if a combined sewer overflow (CSO) event is possible. The MA IHS generates an alert to provide notification of a possible CSO event if the MA IHS determines that a CSO event is possible. In this manner, an operator may take early corrective action before a CSO event occurs.

15 Claims, 8 Drawing Sheets

(56) References Cited

U.S. PATENT DOCUMENTS

| | | | | |
|---|---|---|---|---|
| 2011/0036783 | A1 | 2/2011 | Chezar | |
| 2014/0214891 | A1* | 7/2014 | Quist | G06Q 10/0631 707/770 |

OTHER PUBLICATIONS

United States Environmental Protection Agency(USEPA), Waste Water Collection, Treatment and Storage, USEPA, pp. 4.3-1-4.3-46.*

Everett—"Real Time Combined Sewer Overflow Monitoring"; downloaded from http://www.everettwa.org/CSOMap/CSOMap.aspx; 2005; pp. 1-2.

Ruggaber—"Detection and Control of Combined Sewer Overflows Using a Distributed Wireless Embedded Sensor Network and the In Situ Treatment of Wastewater Using Enzymatic Processes and Hydrogen Peroxide"; A Thesis—Submitted to the Graduate School of the University of Notre Dame in Partial Fulfillment of the Requirements for the Degree of Master of Science; Apr. 2006; pp. 1-135.

Spokane—"Combined Sewer Overflow Update"; downloaded from http://www.spokanewastewater.org/csoupdate.aspx?AspxAutoDetectCookieSupport=1 on Feb. 21, 2013; pp. 1-3.

Wheeler—"Overflows cost sewer systems $35 million in fines"; USA Today; downloaded from http://usatoday30.usatoday.com/news/nation/2008-05-07-sewers-facts_N.htm; May 28, 2008; pp. 1-2.

EPA1—"Combined Sewer Overflows"; National Pollutant Discharge Elimination System (NPDES); downloaded from http://cfpub.epa.gov/npdes/home.cfm?program_id=5; Feb. 16, 2012; pp. 1-3.

EPA2—"Guidance for Nine Minimum Controls"; Combined Sewer Overflows; United States Environmental Protection Agency; Office of Water; May 1995; pp. 1-1 through 10-6.

EPA3—"CSO Post Construction Compliance Monitoring Guidance", United States Environmental Protection Agency; May 2012; pp. 1-234.

EPA4—"Guidance for Monitoring and Modeling"; Combined Sewer Overflows; United States Environmental Protection Agency; Office of Water; Jan. 1999; pp. 1-1 through 9-35.

Fritz—"The Semantic Model: A Basis for Understanding and Implementing Data Warehouse Requirements"; The Data Administation Newsletter: http://www.tdan.com/view-articles/4044; Oct. 1, 2006; pp. 1-4.

Galloway—"Introduction to Industrial Control Networks"; IEEE Communicatons Surveys & Tutorials, Jun. 11, 2012; pp. 1-22.

Gray—"There Goes the Neighborhood: Relational Algebra for Spatial Data Search"; Technical Report; Microsoft Corporation; Apr. 2004: pp. 1-11.

Halper—"Fern Halper's data makes the world go 'round"; What's a semantic model and why should we care?; downloaded from http://fbhalper.wordpress.com/2007/11/29/whats-a-semantic-model-and-why-should-we-care/; Nov. 29, 2007; p. 1-6.

Hanis—"The role of semantic models in smarter industrial operations"; IBM Corporation; developerWorks; Oct. 11, 2011; pp. 1-20.

IBM1—"Using Model Management"; IBM Integrated Information Core; downloaded from http://pic.dhe.ibm.com/infocenter/iicdoc/v1r4m0/topic/com.ibm.iic.doc/model_man/model_man.html; Aug. 2012, pp. 1-4.

IBM2—"Reference Semantic Model"; IBM Integrated Information Core; downloaded from http://pic.dhe.ibm.com/infocenter/iicdoc/v1r4m0/topic/com.ibm.iic.doc/model_man/rsm.html; Aug. 2012; pp. 1-2.

IBM3—"Reference Semantic Model"; IBM Integrated Information Core; downloaded from http://pic.dhe.ibm.com/infocenter/iicdoc/v1r5m0/topic/com.ibm.iic.doc/ov_rsm.html; Aug. 2012, p. 1.

IBM4—"Samples"; IBM Intelligent Water; downloaded from http://pic.dhe.ibm.com/infocenter/cities/v1r5m0/topic/com.ibm.water.doc/ov_samples.html; Aug. 2012, pp. 1-2.

Krishnaswami—"A Semantic Model for Graphical User Interfaces"; Microsoft Research; ICFP 2011, Tokyo, Sep. 19-21, 2011; pp. 1-13.

LinkedData1—"Tutorial 3: Semantic ModelinG": LinkedDataTools.com; downloaded from http://www.linkeddatatools.com/semantic-modeling on Mar. 5, 2013; pp. 1-6.

LinkedData2—"Tutorial 5: Querying Semantic Data"; LinkedData Tools.com; downloaded from http://www.linkeddatatools.com/querying-semantic-data on Apr. 29, 2013; pp. 1-6.

Papadomanolakis—"Efficient Query Processing on Unstructured Tetrahedral Meshes"; SIGMOD, Chicago, IL Jun. 27-29, 2006; pp. 1-12.

SCADA—"Supervisory Control and Data Acquisition (SCADA) Systems"; NCS Technical Information Bulletin 04-1; National Communications System; Oct. 2004; pp. 1-64.

Wiki—SCADA—"SCADA"; From Wikipedia, the free encyclopedia; downloaded from http://en.wikipedia.org/wiki/SCADA; Mar. 27, 2013; pp. 1-10.

Wiki—Semantic—"Semantic data model"; From Wikipedia, the free encyclopedia; downloaded from http://en.wikipedia.org/wiki/Semantic_data_model; Jan. 5, 2013; pp. 1-4.

Office Action dated Apr. 14, 2016 in related U.S. Appl. No. 14/503,337, 13 pages.

* cited by examiner

SEMANTIC MODEL

400

COMBINED SEWER OVERFLOW WARNING AND PREVENTION SYSTEM

BACKGROUND

The disclosures herein relate generally to information handling systems (IHSs), and more specifically, to IHSs that monitor sewer systems. Avoidance of overflow in sewer systems is very desirable to protect the environment. Monitoring systems can help reach that goal.

BRIEF SUMMARY

In one embodiment, a method is disclosed for providing an alert that a combined sewer overflow event is possible in a combined sewer system. The method includes providing a semantic model of a combined sewer system that includes specification information with respect to components of the combined sewer system. The method also includes sensing operating parameter information by a plurality of sensors distributed throughout the components of the combined sewer system. The method further includes receiving, by a monitoring and alerting (MA) information handling system (IHS), operating parameter information from the plurality of sensors. The method still further includes analyzing, by the MA IHS, the operating parameter information received from the plurality of sensors together with to the specification information in the semantic model of the combined sewer system to determine if a combined sewer overflow (CSO) event is possible. The method also includes generating, by the MA IHS, an alert to provide a notification of a possible CSO event if the MA IHS determines that a CSO event is possible.

In another embodiment, a monitoring and alerting (MA) information handling system (IHS) includes a processor. The MA IHS also includes a system memory coupled to the processor. The system memory includes a semantic model of a combined sewer system that includes specification information with respect to components of the combined sewer system. The system memory also includes a monitoring and alerting (MA) engine that is configured to receive operating parameter information sensed by a plurality of sensors distributed throughout the components of the combined sewer system. The MA engine is also configured to analyze the operating parameter information received from the plurality of sensors with respect to the specification information in the semantic model of the combined sewer system to determine if a combined sewer overflow (CSO) event is possible. The MA engine is further configured to generate an alert to provide a notification of a possible CSO event if the MA engine determines that a CSO event is possible.

In yet another embodiment, a monitoring and alert (MA) computer program product is disclosed that includes a non-transitory computer readable storage medium. The MA computer program product includes first instructions that access a semantic model of a combined sewer system that includes specification information with respect to components of the combined sewer system. The MA computer program product also includes second instructions that receive operating parameter information sensed by a plurality of sensors distributed throughout the components of the combined sewer system. The MA computer program product further includes third instructions that analyze the operating parameter information received from the plurality of sensors with respect to the specification information in the semantic model of the combined sewer system to determine if a combined sewer overflow (CSO) event is possible. The MA computer program product also includes fourth instructions that generate an alert to provide a notification of a possible CSO event if the MA engine determines that a CSO event is possible. The first, second, third and fourth instructions are stored on the non-transitory computer readable storage medium.

BRIEF DESCRIPTION OF THE DRAWINGS

The appended drawings illustrate only exemplary embodiments of the invention and therefore do not limit its scope because the inventive concepts lend themselves to other equally effective embodiments.

DETAILED DESCRIPTION

A combined sewer is a type of sewer that combines both stormwater and sanitary sewage (i.e. wastewater) in a common pipe or channel. Combined sewers may cause serious environmental damage when an overflow occurs, such as when there is a large variation in flow between times when the weather is dry and times when the weather is wet. Combined sewers are no longer permitted in many newer communities with recent construction. However, many older cities especially in the Northeast, the Great Lakes region and Pacific Northwest still employ combined sewers. A combined sewer overflow (CSO) event occurs when stormwater overwhelms the combined sewer so that wastewater and stormwater flow directly into a river, stream, lake or ocean.

The disclosed monitoring and alert (MA) system employs a detailed semantic model of the components that form the infrastructure of the sewer system. The MA system monitors sensed conditions throughout the sewer system long before a CSO event actually occurs. In this manner, it becomes possible to predict a CSO event that might be avoided by appropriate responsive action. System operators may thus act in response to a CSO warning alert to prevent the CSO event. By monitoring sewer levels during both dry weather and wet weather the disclosed MA system assists the operator in assuring that sewer levels do not exceed a point at which a CSO is likely.

Figure 1A:
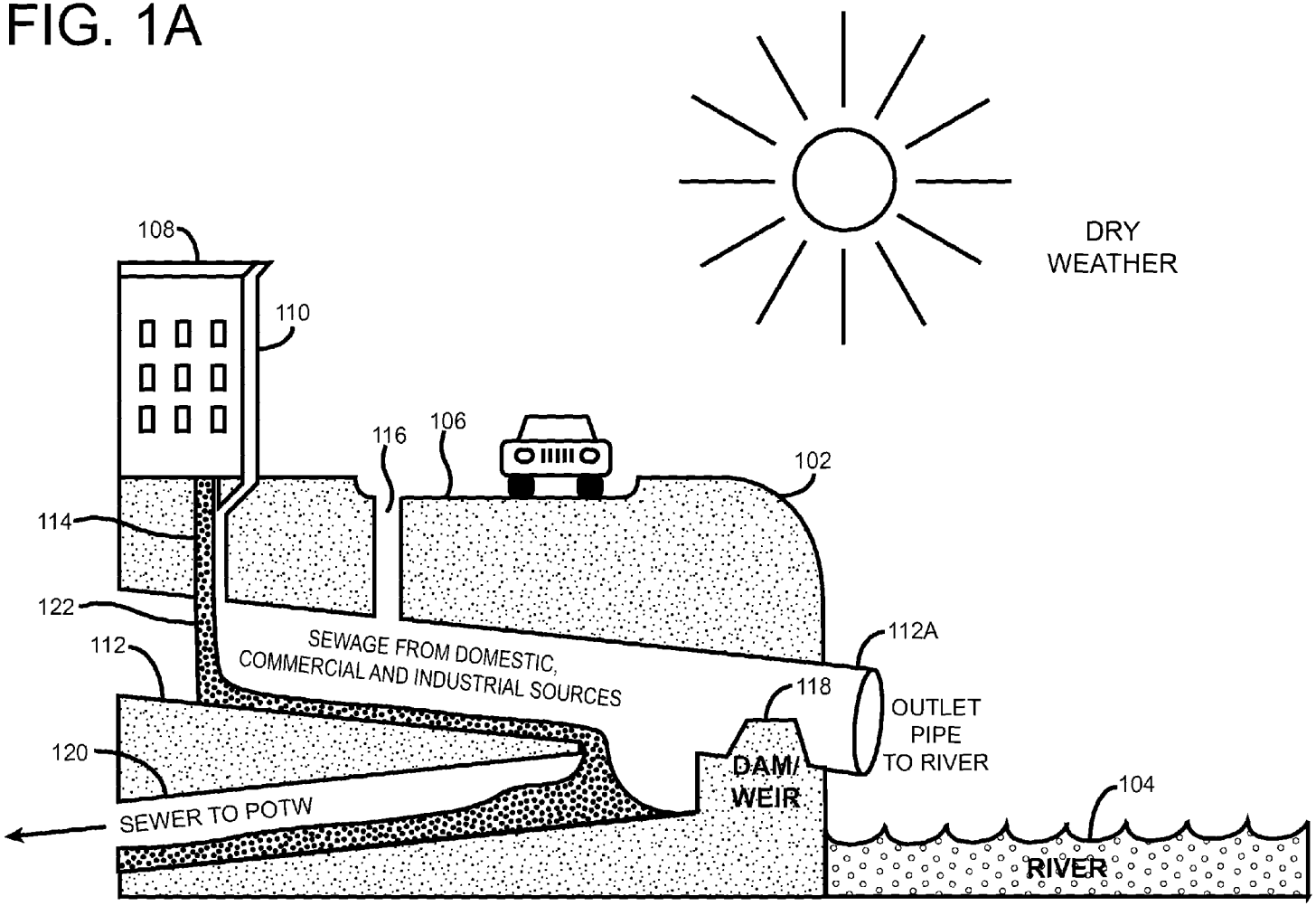
FIG. 1A is a representation of the environment in which the disclosed monitoring and alert system may operate during dry weather conditions.

FIG. 1A is a representation of a dry weather environment in which the disclosed MA system may operate. The environment includes land 102 that is adjacent to river 104. A street 106 is adjacent building 108. Building 108 includes a downspout 110 that carries collected stormwater from the roof of building 108 to a large diameter sewer pipe 112 below building 108. Sewer pipe 112 slopes downwardly toward river 104 and ends at pipe outlet 112A. A small diameter sewage pipe 114 carries sanitary sewage, i.e. wastewater, from building 108 to large diameter sewer pipe 112 below, as shown in FIG. 1A. Sewer pipe 112 carries sewage from domestic, commercial and industrial sources, of which building 108 is one example. A storm drain 116 collects stormwater from street 106 and carries the stormwater to sewer pipe 112 below. The sewage infrastructure also includes a weir 118, i.e. a small dam, situated adjacent pipe outlet 112A as shown. Sewer pipe 112 couples adjacent weir 118 to another downward sloping large diameter sewer pipe 120 that connects to a publicly owned treatment works (POTW), not shown. In times of dry weather, sanitary sewage 122 from building 108 travels down sewage pipe 114 and along sewage pipe 112 but does not reach pipe outlet 112A at river 104 due to the blocking action of weir 118. As long as the level of sewage in pipe 112 is below the top of weir 118, all sewage flows to the POTW via pipe 120, as shown. In dry weather, the risk of wastewater overtopping weir 118 may be low. However, even in dry weather a CSO may occur. For example, a system blockage may result in a CSO even though the weather is dry. The penalties for a CSO event in dry weather may be even higher than penalties imposed for CSO events in wet weather.

Figure 1B:
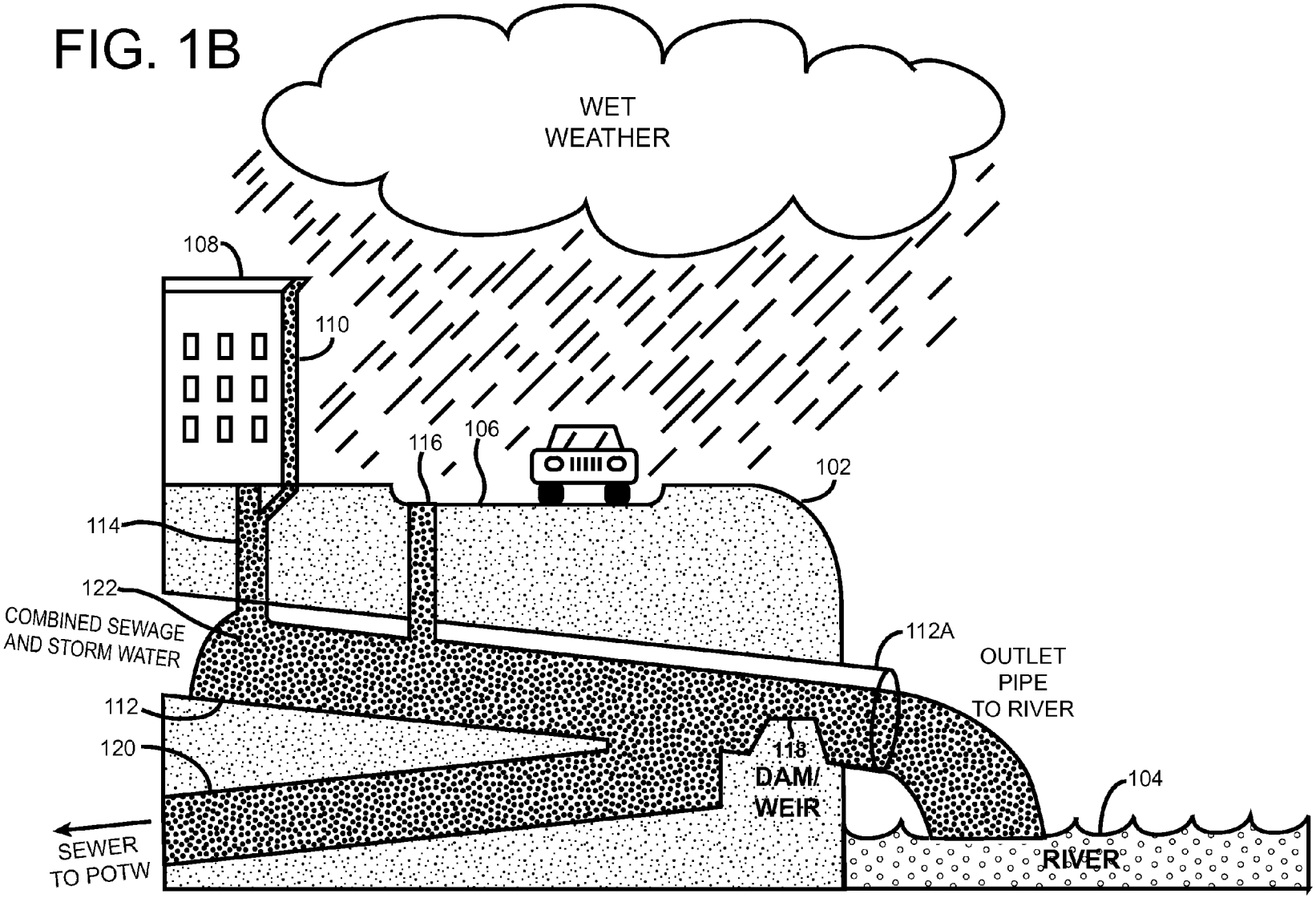
FIG. 1B is a is a representation of the environment in which the disclosed monitoring and alert system may operate during wet weather conditions.

FIG. 1B a representation of a wet weather environment in which the disclosed MA system may operate. FIG. 1B is similar to FIG. 1A with like numbers indicating like elements. In a wet weather environment, wastewater enters large diameter sewer pipe 112 via sewage pipe 114 as before; however, large diameter sewage pipe 112 also receives stormwater from downspout 110, storm drain 116 and other sources of stormwater, not shown. The resultant combined flow of wastewater and stormwater may reach such a high level in pipe 112 that they flow over the top of weir 118 and spill into river 104. This is the combined sewer overflow (CSO) event that the disclosed MA system seeks to avoid.

Figure 2:
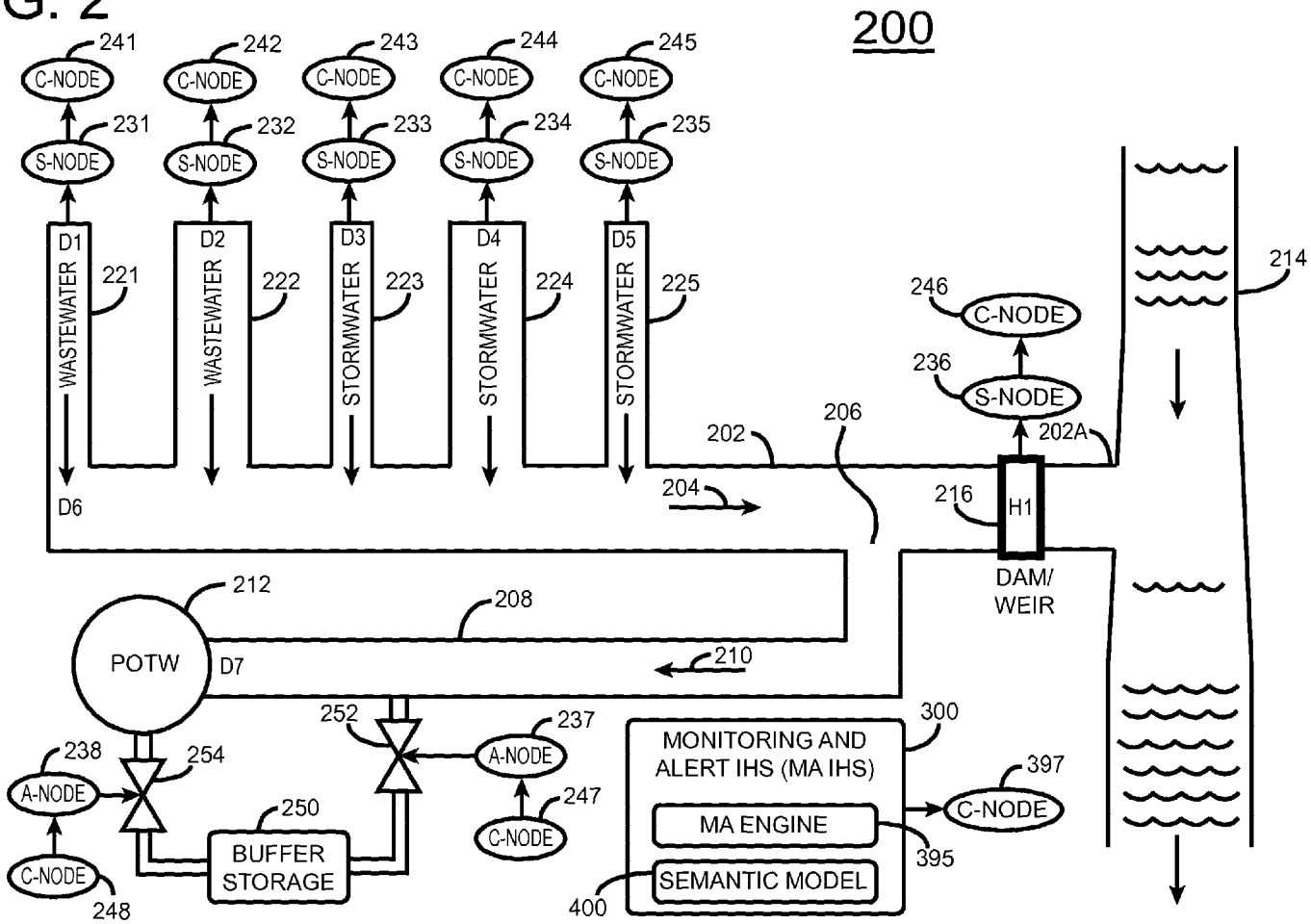
FIG. 2 is a block diagram of one embodiment of the disclosed monitoring and alert system.

FIG. 2 is a representation of the disclosed monitoring and alert (MA) system 200. For discussion purposes, FIG. 2 shows a small representative portion of MA system 200. In actual practice, MA system 200 may be scaled up and be much larger than depicted. The disclosed MA system 200 monitors liquid levels and other parameters in the sewer pipes of the sewer system during both dry weather and wet weather. In one embodiment, MA system 200 includes a MA IHS 300 that accesses a semantic model 400 of the sewer system to predict when a CSO event is possible. In this manner, preventative action can be taken by an operator. In one embodiment, semantic model 400 desirably includes specification information and operating parameter information with respect to each of the components of the sewer system. For example, the sewer system of FIG. 2 includes a large diameter, main sewer pipe 202 through which water flows in the direction that arrow 204 indicates. Semantic model 400 stores the diameter of sewer pipe 202 as specification information for sewer pipe 202. Semantic model 400 may also store typical flow rates through pipe 202 as operating parameter information for sewer pipe 202.

Sewer pipe 202 includes a junction 206 at which another large diameter sewer pipe, namely treatment sewer pipe 208, connects to carry fluid downstream in the direction of arrow 210 to publicly-owned treatment works (POTW) 212. The diameter of treatment sewer pipe 210 is form of specification information that semantic model 400 stores with respect to treatment sewer pipe 208. Downstream of arrow 204, sewer pipe end 202A connects to a river, stream, lake, ocean or other body of water 214. The sewer system includes a weir 216, i.e. a small dam, that exhibits a height, H1, between junction 206 and sewer pipe end 202A. As long as the fluid flow at weir 216 does not exceed H1, the fluid does not overtop weir 216 and flow into body of water 214. Semantic model 400 stores the height, H1, of weir 216 as an important piece of component specification information with respect to weir 216.

Wastewater pipes 221 and 222, and stormwater pipes 223, 224 and 225 couple to main sewer pipe 202 along the length thereof as shown in FIG. 2. Semantic model 400 stores diameters D1, D2, D3, D4 and D5 for pipes 221, 222, 223, 224 and 225, respectively as specification information for those components. Sensor nodes, i.e. S-nodes, 231, 232, 233, 234 and 235 measure operating parameters associated within pipes 221, 222, 223, 224 and 225, respectively. These operating parameters may include fluid depth, flow rate, temperature and other operating parameters. S-nodes 231, 232, 233, 234 and 235 send the collected operating parameters to MA IHS 300 via communication nodes, i.e. C-nodes, 241, 242, 243, 244 and 245, respectively. MA IHS 300 employs a C-node 397 to receive parameters from C-nodes 241, 242, 243, 244 and 245. C-nodes 241, 242, 243, 244 and 245, and 397 may be wireless transceivers that communicate between MA IHS 300 and the S-nodes. Alternatively, wired connections may be employed between MA IHS 300 and the S-nodes to obtain the sensed operating parameters at each pipe. In one embodiment, each communication node exhibits a different address. In that embodiment, MA IHS 300 may employ its C-node 397 to individually interrogate each of the C-nodes in the system to obtain operating parameter information from the respective sensors thereof. If a particular sensed operating parameter is more important than other operating parameters, MA IHS 300 may be configured to interrogate that sensor more frequently than other sensors. For example, in one embodiment, MA IHS 300 may interrogate sensor S-node 236 via C-node 246 to receive fluid level operating parameter information regarding weir 206 more frequently than other operating parameters in the system.

In one embodiment, the sewer system of FIG. 2 includes a buffer storage 250 that couples to treatment sewer pipe 208 to enable temporary storage of water needing treatment when a large quantity of water flows into treatment pipe 208 that might otherwise result in the overtopping of weir 206 to cause a CSO event. Buffer storage 250 connects to treatment sewer pipe 208 via an input valve 252. An actuator node 247, i.e. an A-node, couples to input valve 252 and C-node 247, as shown. Actuator node 237 is capable of opening and closing input valve 252 on command from MA IHS 300 or other operator command source. In this manner, MA IHS 300 may communicate a command via C-node 397, C-node 247 and A-node 237 to open input valve 252 to allow fluid to flow into buffer storage 250 when needed to prevent a CSO event. When MA IHS 300 determines that the CSO event potential is past, then MA IHS 300 may command A-node 238 via C-node 248 to open output valve 254 to allow the fluid in buffer storage 250 to flow into POTW for treatment.

Figure 4:
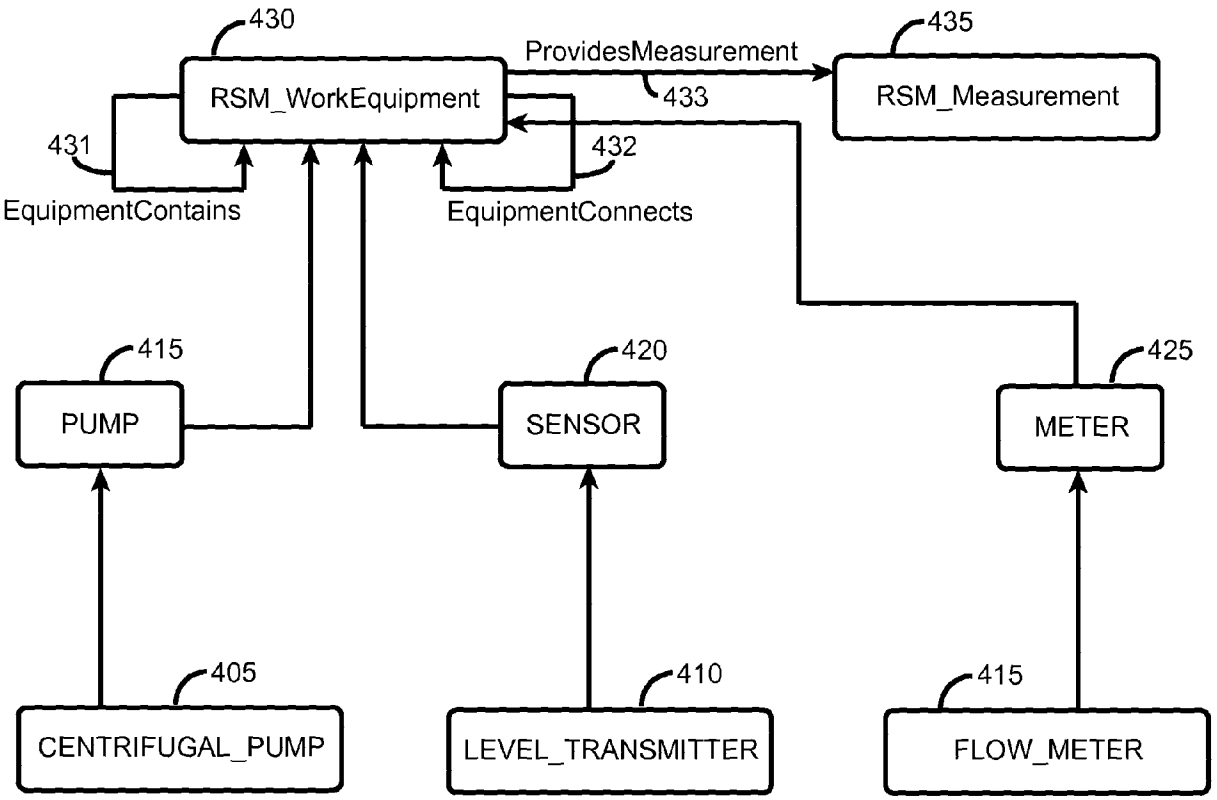
FIG. 4 is a representative semantic model that the disclosed monitoring and alert system may employ.

Table 1 below illustrates a portion of a simplified semantic model 400 that, in a preferred embodiment, stores operating parameter information concerning each interconnected component of the sewer system infrastructure such as pipes, pumps, valves, weirs and channels, for example. Semantic model 400 describes the components, processes and characteristics of the sewer system in a unified manner. FIG. 4 shows a more detailed representation of semantic model 400 that describes the multiple interconnected structures that form MA system 200.

TABLE 1

SIMPLIFIED SEMANTIC MODEL

| COMPONENT NAME | DESCRIPTION | VALUE | UNITS |
|---|---|---|---|
| WASTEWATER PIPE 221 | DIAMETER | D1 | FEET |
| WASTEWATER PIPE 221 | CIRCUMFERENCE | C1 | FEET |
| WASTEWATER PIPE 221 | NORMAL FLOW RATE RANGE | X1 TO Y1 | GPM |
| WASTEWATER PIPE 222 | DIAMETER | D2 | FEET |
| WASTEWATER PIPE 222 | CIRCUMFERENCE | C2 | FEET |
| WASTEWATER PIPE 222 | NORMAL FLOW RATE RANGE | X2 TO Y2 | GPM |
| STORMWATER PIPE 223 | DIAMETER | D3 | FEET |
| STORMWATER PIPE 223 | CIRCUMFERENCE | C3 | FEET |
| STORMWATER PIPE 223 | NORMAL FLOW RATE RANGE | X3 TO Y3 | GPM |
| STORMWATER PIPE 224 | DIAMETER | D4 | FEET |
| STORMWATER PIPE 224 | CIRCUMFERENCE | C4 | FEET |
| STORMWATER PIPE 224 | NORMAL FLOW RATE RANGE | X4 TO Y4 | GPM |
| STORMWATER PIPE 225 | DIAMETER | D5 | FEET |
| STORMWATER PIPE 225 | CIRCUMFERENCE | C5 | FEET |
| STORMWATER PIPE 225 | NORMAL FLOW RATE RANGE | X5 TO Y5 | GPM |
| MAIN PIPE 202 | DIAMETER | D6 | FEET |
| MAIN PIPE 202 | CIRCUMFERENCE | C6 | FEET |
| MAIN PIPE 202 | NORMAL FLOW RATE RANGE | X6 TO Y6 | GPM |
| TREATMENT PIPE 208 | DIAMETER | D7 | FEET |
| TREATMENT PIPE 208 | CIRCUMFERENCE | C7 | FEET |
| TREATMENT PIPE 208 | NORMAL FLOW RATE RANGE | X7 TO Y7 | GPM |
| WEIR 206 | HEIGHT | H1 | FEET |
| POTW 212 | PROCESSING CAPACITY | P1 | GPM |

Semantic model 400 stores the diameter, circumference, and normal flow rate ranges of wastewater pipes 221, 222, stormwater pipes 223, 224, 225, main sewer pipe 202 and treatment sewer pipe 208. Semantic model 400 also stores the height of weir 206, namely H1. In this manner, MA IHS 300 knows that height at which overtopping of weir 206 begins and CSO commences. In actual practice, semantic model 400 differs from a relational database in that it models the relationships among the entities of the combined sewer system, each entity being modeled with respect to other entitles of the model. In this manner, interactions among the entities of MA system 200 may be understood. These entities include nodes such as sensor nodes as well as other nodes and components of the sewer system. The semantic model may include flow direction for the pipes that form the sewer system. FIG. 4 provides a more detailed representation of the semantic model 400 that MA system 200 may employ to describe the many interconnected structures of the infrastructure of MA system 200.

Monitoring and alert (MA) IHS 300 includes a monitoring and alert (MA) engine 395 that interrogates and collects data from the sensors distributed throughout the sewer system. MA engine 395 compares the collected data with the data in semantic model 400 to make a determination of whether or not a CSO is likely. For example, MA engine 395 monitors the flow rates from the sensors associated with all pipes of the system over time. MA engine 395 knows how much fluid POTW 212 can process per unit time via processing capacity information P1 that semantic model 400 stores to describe the processing capacity of POTW 212. MA engine 395 also knows the weir height H1 to which fluid level may rise at weir 216 before CSO occurs. In other words, MA engine 395 collects flow rate operating parameter information from the distributed sensors in the system and accesses the stored specification information and stored operating parameter range information in semantic model 400 to determine if the flow through main pipe 202 is sufficient to cause concern that an overtopping of weir 206, namely a CSO, may occur. If so, MA IHS 300 generates an alert to notify the operator before the CSO actually occurs, thus allowing the operator to take corrective action to avoid the CSO. One such corrective action is for the operator to command MA IHS 300 to instruct input valve 252 to open and provide temporary storage of fluid in buffer storage 250.

Figure 3:
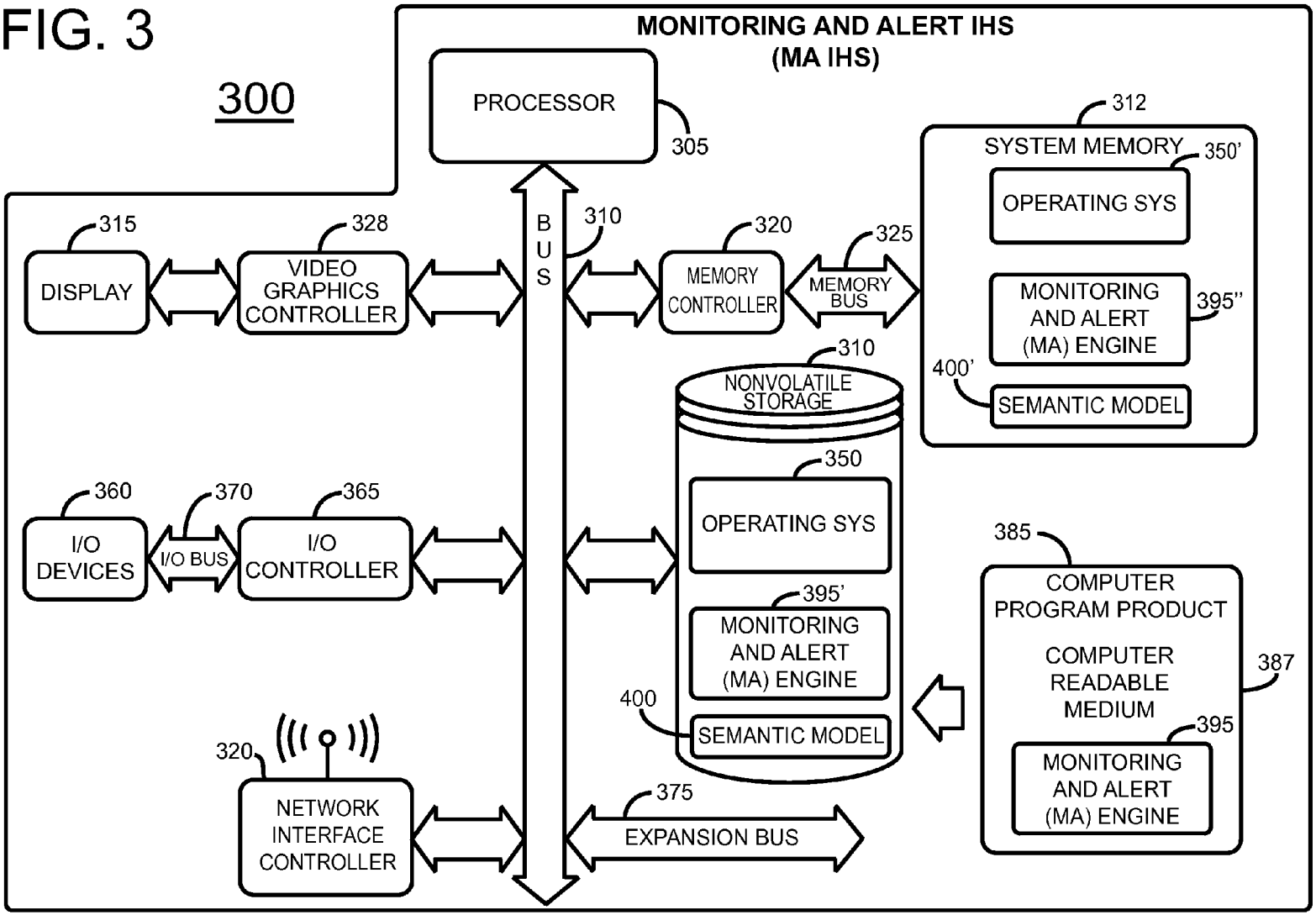
FIG. 3 is a block diagram of a monitoring and alert information handling system (MA IHS) that the disclosed monitoring and alert system may employ.

FIG. 3 is a block diagram of an information handling system that may be employed as monitoring and alert (MA) IHS 300 to practice the disclosed methodology. MA IHS 300 includes a processor 305 that may include multiple cores. MA IHS 300 processes, transfers, communicates, modifies, stores or otherwise handles information in digital form, analog form or other form. MA IHS 300 includes a bus 310 that couples processor 305 to memory 312 via a memory controller 320 and memory bus 325. System memory 312 may also be referred to as main memory. System memory 312 may be a static random access memory (SRAM) array or a dynamic random access memory (DRAM) array. Processor 305 may also include local memory such as L1, L2 and L3 caches. A video graphics controller 328 couples display 315 to bus 310. Nonvolatile storage 310, such as a hard disk drive, solid state drive (SSD), CD drive, DVD drive or other nonvolatile storage couples to bus 310 to provide DVR IHS 300 with permanent storage of information. System memory 312 and nonvolatile storage 310 are both forms of memory stores. Nonvolatile storage 310 stores an operating system 350 (OPERATING SYS) that governs operation of MA IHS 300. Nonvolatile storage 210 also stores semantic model 400. Nonvolatile storage 310 further stores one or more applications, such as monitoring and alert (MA) engine 395', that processor 305 executes. I/O devices 360, such as a keyboard and a pointing device, couple to bus 310 via I/O controller 365 and I/O bus 370.

One or more expansion busses 375, such as USB, IEEE 1394 bus, ATA, SATA, PCI, PCIE, DVI, HDMI and other busses, couple to bus 310 to facilitate the connection of peripherals and devices to MA IHS 300. A network interface controller (NIC) 320 couples to bus 310 to enable MA IHS 300 to connect by wire or wirelessly to a network and/or other information handling systems. Network interface controller 320 may also be called a network communication adapter or a network adapter. While FIG. 3 shows one IHS that employs processor 305, the IHS may take many forms. For example, IHS 300 may take the form of a desktop, server, portable, laptop, notebook, tablet, or other form factor computer or data processing system. IHS 300 may take other form factors such as a gaming device, a personal digital assistant (PDA), a portable telephone device, a communication device or other devices that include a processor and memory.

In one embodiment, MA IHS 300 employs a monitoring and alert (MA) engine computer program product 395 that includes a MA engine 395 stored on a computer readable medium 387 such as a CD, DVD, flash drive or other media. In actual practice, a user or other entity may load MA engine 395 in non-volatile storage 310 as MA engine 395'. Nonvolatile storage 310 may also store operating system (OPERATING SYS) 350 and semantic model 400. When MA IHS 300 initializes, the MA IHS loads MA engine 395', semantic model 400 and operating system 350 into system memory 312 for execution as MA engine 395", semantic model 400' and operating system 350'. The flowchart of FIG. 4 provides more detail with respect to the operation of MA engine 330 and is discussed in more detail below.

FIG. 4 is an entity relationship (ER) diagram of semantic model 400. The ER diagram of FIG. 4 describes the nodes and connections among the nodes of semantic model 400. In other words, the ER diagram of FIG. 4 describes the entities within semantic model 400 and the relationships among those entities. In one embodiment, semantic diagram 400 represents the accumulated knowledge of all entities within the combined sewer system and the connections among those entities.

Semantic model 400 includes entities CENTRIFUGAL_PUMP 405, LEVEL_TRANSMITTER 410 and FLOW_METER 415 that represent the respective physical objects centrifugal pump, level transmitter and flow meter. The entities CENTRIFUGAL_PUMP 405, LEVEL_TRANSMITTER 410 and FLOW_METER 415 feed entities pump 415, sensor 420 and meter 425, as shown in FIG. 4. Entities pump 415, sensor 420 and meter 425 all feed base entity RSM_WorkEquipment 430. The RSM_WorkEquipment entity 430 acts as a base for pump entity 415, sensor entity 420 and meter entity 425. In this particular example, pump entity 415 acts as a base for CENTRIFUGAL_PUMP entity 405. Sensor entity 420 acts as a base for LEVEL_TRANSMITTER entity 410. Meter entity 425 acts as a base for FLOW_METER 415.

Semantic model 400 includes an EquipmentContains arrow 431 that both extends from, and points to, the RSM_WorkEquipment entity 430. Semantic model 400 also includes an EquipmentConnects arrow 432 that both extends from, and points, to the RSM_WorkEquipment entity 430. Arrows 431 and 432 indicate that each piece of equipment, such as a pump, sensor and meter, may contain other pieces of equipment and connect to other pieces of equipment. Semantic diagram 400 includes a ProvidesMeasurment arrow 433 extending from RSM_WorkEquipment entity 430 to an RSM_Measurement entity 435. This indicates that every piece of work equipment can be associated with the RSM_Measurement entity 435.

Entities within semantic model 400 may exhibit inheritance. For example, pump 415, sensor 420 and meter 425 may inherit from work equipment such as CENTRIFUGAL_PUMP entity 405, LEVEL_TRANSMITTER entity 410 and FLOW_METER 415.

In summary, semantic model 400 represents entities that include all forms of equipment in the combined sewer system associated with monitoring and alert system 200. Semantic model 400 includes the connections among the pieces of equipment. The entities within semantic model 400 may exhibit connections to other entities and exhibit containment to themselves. In other words, each entity may connect to other entities and each entity may contain other entities.

Figure 5:
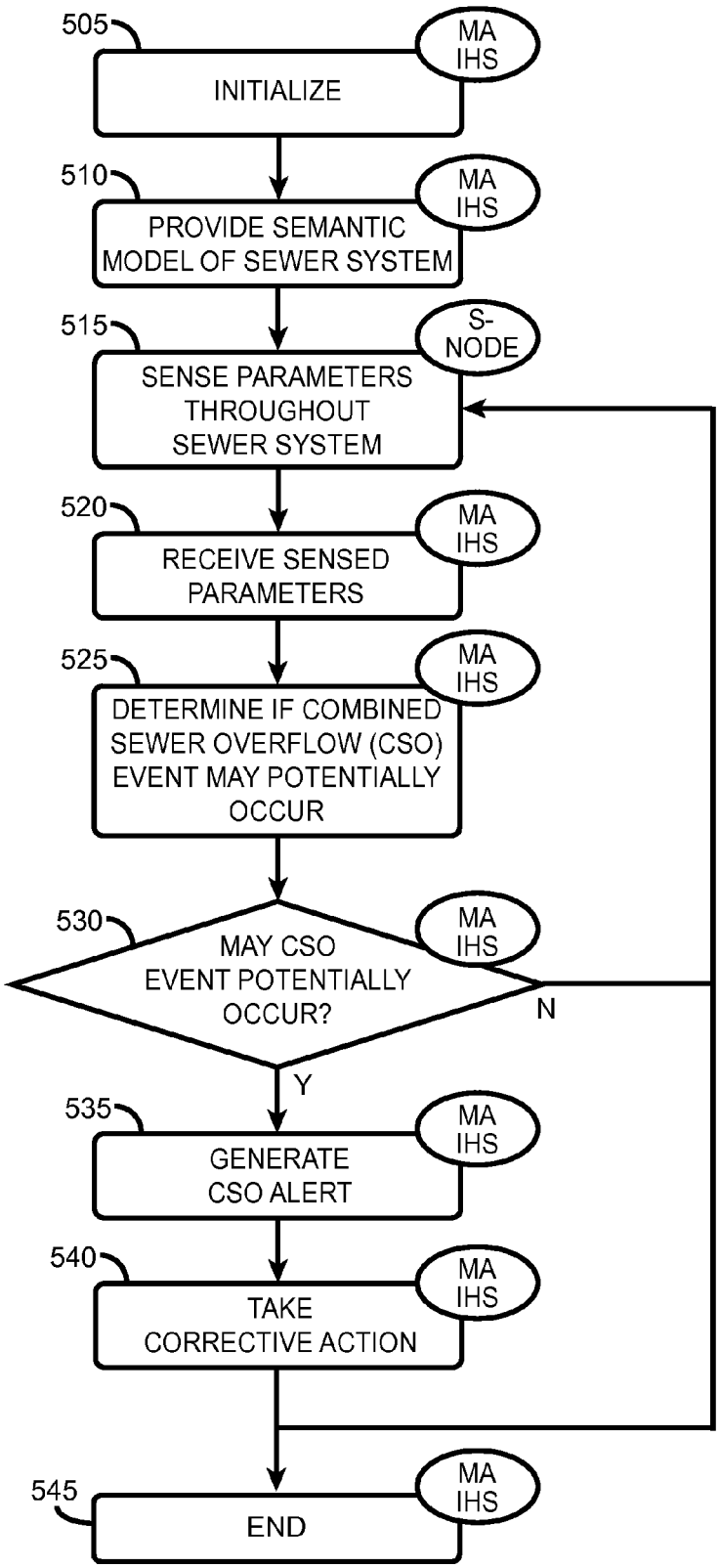
FIG. 5 is a flowchart that shows a simplified process flow for the disclosed monitoring and alert system.

FIG. 5 is a simplified flowchart that depicts a representative process flow in the operation of monitoring and alert (MA) engine 395 in MA IHS 300. Process flow commences when processor 205 initializes, as per block 505. A technician or operator installs semantic model 400 in MA IHS 300, as per block 510. For example, the technician or operator may install semantic model 400 in nonvolatile storage 310. The technician or operator also installs monitoring and alert (MA) engine 395 on nonvolatile storage 310 of MA IHS 300. The sensing nodes, i.e. S-nodes, of system 200 sense operating parameters at the many components throughout the sewer system, such as wastewater pipes, stormwater pipes, main pipes, channels and weirs, as per block 515. MA engine 395 receives the sensed operating parameters, as per block 520. MA engine 395 determines if a CSO event may potentially occur under current sensed conditions, as per block 525. If a CSO event may potentially occur under the current sensed conditions, then decision block 530 calls for the generation of a CSO alert, as per block 535. The operator may take corrective action to avoid an impending CSO event, as per block 540. Process flow may end at and block 445, or continues back to sense parameters block 515. If MA engine 295 does not determine that a CSO event may potentially occur at block 530, then process flow continues back to sensing block 515 and sensing operations continue to monitor the state of system 200.

In another embodiment, MA IHS 300 may receive local weather forecasts so that MA engine 395 knows of upcoming weather conditions indicating a large amount of rain. In the event of an impending rainstorm and if MA IHS 300 determines that a CSO event is possible, MA engine 395 may alert the operator to create additional space in the sewer system to accommodate the expected water collection resulting from the storm. Alternatively, in the event of a possible CSO event, MA engine 395 may in response open input valve 252 to allow buffer storage 250 to create additional room for water flow.

In one embodiment, a community sewer system includes many POTWs, main pipes, wastewater pipes, stormwater pipes and weirs, of which FIG. 2 shows one example of a portion of such large system A single MA IHS 300 with its semantic model 400 of the entire system and MA engine 395 may cooperate to provide monitoring and alerting capability for these more complex systems. MA engine 395 considers weir height in sewers pipes of different height in determining when a CSO event is possible and the predicted location of that CSO event. In one embodiment, MA IHS 300 may couple to, and receive information from, a supervisory control and data acquisition (SCADA) system that couples to and controls the sewer system. Semantic model 400 defines the height of each CSO event, for example the weir height H1 of weir 216 that when exceeded results in a CSO event. Weir 216 acts as a CSO diversion structure until flow exceeds height H1. An existing SCADA system may provide MA engine 395 with a flag to indicate that the current event is a wet weather event or a dry weather event.

In one embodiment, display 315 of MA IHS 300 shows a pictorial image of the sewer system such as the pictorial image that FIG. 2 depicts. In this embodiment, the operator may click on a component to learn more information about that component and current operating parameter conditions at that component. For example, the operating may click on or select weir 216 to request information about weir 216. In response, MA IHS 300 displays the weir height H1 and the fluid depth or level at weir 216. The operator may click on wastewater pipe 221 to see a display of the diameter D1 of wastewater pipe 221 and the current level and flow rate through that pipe. The operator may also view typical normal flow rates and view past range of flow rates through that pipe. The operator may click on stormwater pipe 223 to see a display of the diameter D3 of stormwater pipe 223 and the current level and flow rate through that pipe. MA engine 400 may access both semantic model 400 and currently sensed conditions to display the requested information in response to a user request. In one embodiment, the above described features may all cooperate to assist the operator in avoiding a CSO event by providing a unified view of the operation of the components of the entire sewer system.

Figure 6:
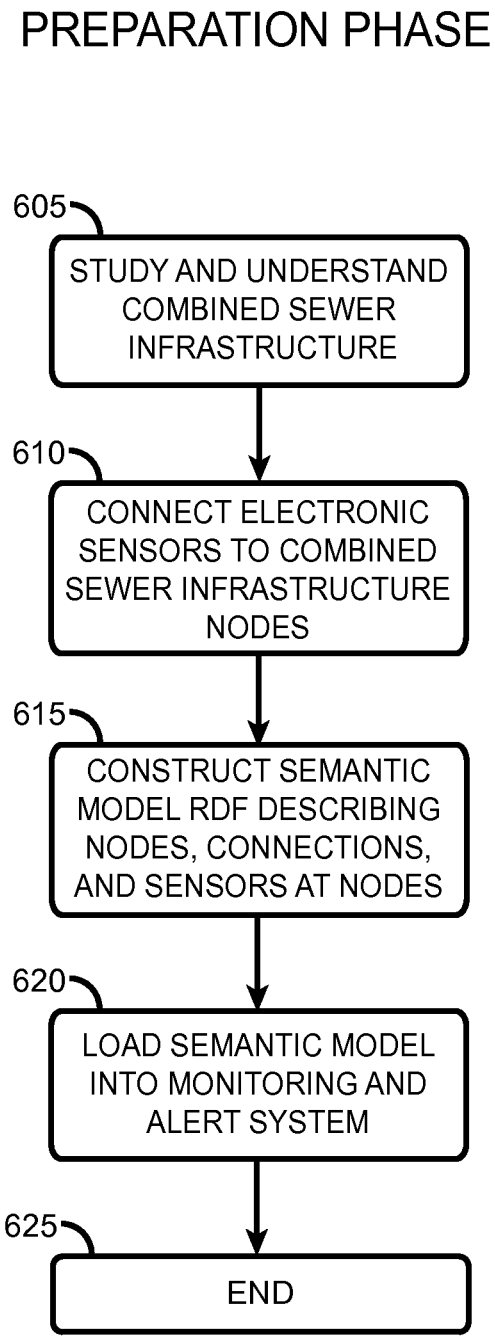
FIG. 6 is a flowchart that shows a representative process flow for a preparation phase of the disclosed monitoring and alert system.
Figure 7:
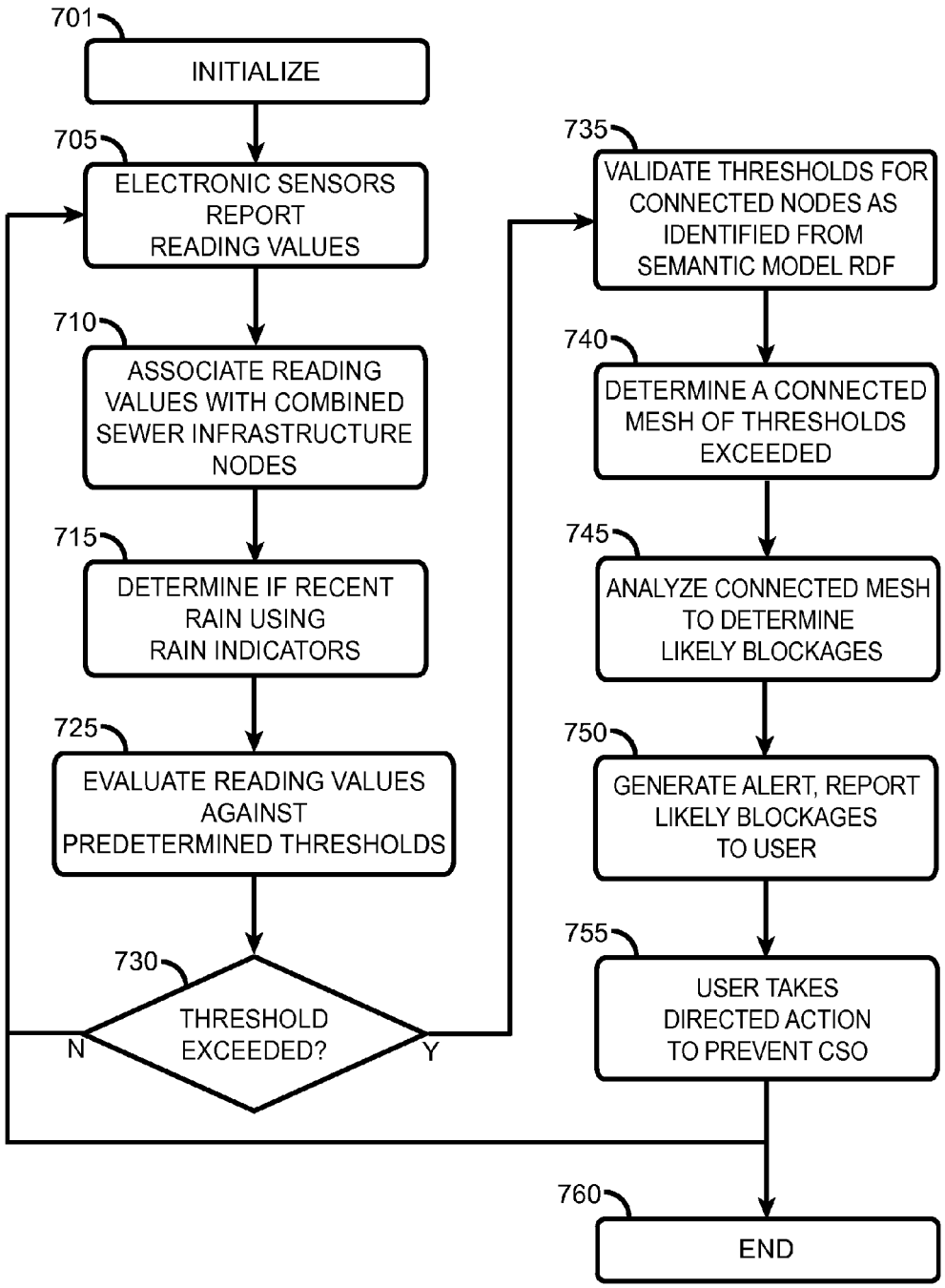
FIG. 7 is a flowchart that shows a representative process flow for a detection phase of the disclosed monitoring and alert system.

FIG. 6 and FIG. 7 are more detailed flowcharts that depict operation of the disclosed methodology. More specifically, FIG. 6 is a flowchart that shows the preparation phase of the process flow of the disclosed methodology. FIG. 7 is a flowchart that shows the detection phase of the process flow of the disclosed methodology.

In the flowchart of FIG. 6 that depicts the preparation phase, process flow commences with studying and understanding the existing combined sewer infrastructure, as per block 605. For example, the designers may consult existing architectural and construction diagrams that describe the combined sewer system including its many components such as pipes, channels, valves, weirs, junctions, pumps, treatment plants, and bodies of water to name a few. These components connect with one another and interact with one another. In the preparation phase, installation personnel install electronic sensors to nodes in the sewer infrastructure, as per block 610. These sensors may sense operational parameters of interest such as water depth, flow rate, flow direction and other parameters of interest. FIG. 2 shows several representative nodes in a combined sewer system. These nodes include wastewater pipes, stormwater pipes, main pipes and channels, weirs, pumps, valves and other nodes of interest.

The designer constructs a semantic model 400 of the combined sewer infrastructure, as per block 615. In one embodiment, the designer constructs an resource description framework (RDF) file that describes the combined sewer infrastructure including nodes, connections among nodes and sensors at nodes. The RDF file specifies the complete topology of the combined sewer system, including all nodes, the connections among nodes, the electronic sensors and where those electronic sensors are placed with respect to the nodes. A user loads the semantic model 400 into MA IHS 300, as per block 625. The preparation phase terminates at end block 625.

FIG. 7 depicts the detection phase in which MA IHS 300 operates during its day-to-day CSO detection and alerting activities. Process flow initializes, as per block 701. The electronic sensors in the combined sewer system send "reading values" back to MA IHS 300 of MA system 200, as per block 705. These electronic sensors provide raw data to MA IHS 300. MA IHS 300 accesses semantic model 400 to associate the reading values with the respective nodes to which those reading values correspond, as per block 710. In this manner, MA IHS 300 places the received raw data into context so that MA IHS 300 knows the particular node from which each piece of raw data came.

MA IHS 300 performs a test to determine if it has rained recently using rain indicators (not shown), as per block 715. It is expected that a CSO event may occur during wet weather. However, a CSO event typically occurs in dry weather only if there is a blockage in the system or there is some other failure that requires attention. A rain indicator is an example of another type of infrastructure node that the combined sewer system employs.

MA IHS 300 evaluates the received reading values from the sensors against predetermined thresholds, as per block 725. For example, MA engine 395 may test the fluid depth that S-node 232 detects in wastewater pipe 222 to determine if that fluid depth exceeds a predetermined threshold level. In another example, MA engine 395 may test the fluid depth that S-node 235 detects in stormwater pipe 225 to determine if that fluid depth exceeds another predetermined threshold level. In yet another example, MA engine 395 may test the fluid depth at S-node 236 to determine if that fluid depth exceeds a predetermined threshold level that corresponds to overtopping of weir 216. If a threshold or thresholds are exceeded at decision block 730, then MA engine 395 validates thresholds for connected nodes as identified from the semantic model RDF file, as per block 735. If it is determined that no thresholds are exceeded, then MA IHS 300 continues monitoring reading values, as per blocks 705 and 710.

In one embodiment, MA IHS 300 may employ a different respective threshold for each node that MA IHS 300 tests and evaluates. As an example (not shown) a particular combined sewer system may include nodes A, B and C that represent overflow valves, nodes D, E and F that represent pipes at which sensors sense fluid depth, and nodes G, H and I that represent other infrastructure. The threshold for the overflow valve of node A may be a particular predetermined depth that is known to correspond to a CSO event if exceeded. The threshold for node D may be a flow rate value of 12 gallons per minute. Thus, different nodes may exhibit different types of thresholds and magnitudes of thresholds. Understanding the context based on the semantic model enables comparison of each sensor reading with an appropriate respective threshold.

MA engine 395 determines a connected mesh of nodes for which respective thresholds are exceeded, as per block 740. When MA engine 395 queries semantic model 400 to determine those nodes for which a respective threshold is exceeded, or is otherwise outside of a normal operating tolerance range of values, the result is a connected mesh of nodes. A mesh may be a form of graph or network. MA engine 395 analyzes this connected mesh to determine likely blockages, as per block 745. More particularly, MA engine 395 knows for which particular nodes the respective thresholds have been exceeded. MA engine 395 stores this information in the form of the connected mesh. To determine the likely location of a blockage, MA engine 395 accesses the connected mesh and locates a particular node where the threshold is exceeded. This is a "threshold exceeded node". MA engine 395 then checks other nodes to which the threshold exceeded node is connected to determine if thresholds at those nodes have been exceeded as well. MA engine 395 traces from node to node in the connected mesh in this manner observing whether or not each respective node threshold is exceeded to determine the likely location of the blockage. For example, consider the case of a particular pipe that includes three nodes with respective fluid depth sensors. If the fluid depths of the first and second nodes exceed their respective thresholds, whereas the fluid depth of the third node does not exceed its respective threshold, then MA engine 395 determines that the likely source of the blockage is between the second node and the third node.

When a sensor indicates that a particular node exceeds its threshold, MA IHS 300 generates an alert to notify the user. When a likely blockage is identified as described above, MA IHS 300 also generates an alert to notify the user, as per block 750. The alert may take the form of a message on a display, a text message to the user, and/or a work order sent to personnel who will work to remove the blockage. The alert may include the likely location of the blockage. Generating an alert in this manner may enable the avoidance of a CSO event or shorten the duration of a CSO event by notifying personnel quickly so that system blockages or other system faults may be repaired, as per block 755. Process flow terminates at block 760.

As will be appreciated by one skilled in the art, aspects of the disclosed methodology may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the FIG. 4 flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart of FIG. 4 and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart of FIG. 4 described above.

The flowchart of FIG. 4 illustrates the architecture, functionality, and operation of possible implementations of systems, methods and computer program products that perform analysis in accordance with various embodiments of the present invention. In this regard, each block in the flowcharts of FIGS. 7 and 8 may represent a module, segment, or portion of code, which comprises one or more executable instructions for implementing the specified logical function(s). It should also be noted that, in some alternative implementations, the functions noted in the block may occur out of the order noted in FIG. 4. For example, two blocks shown in succession may, in fact, be executed substantially concurrently, or the blocks may sometimes be executed in the reverse order, depending upon the functionality involved. It will also be noted that each block of FIG. 4 and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A monitoring and alerting (MA) information handling system (IHS), comprising:

a processor:

a system memory coupled to the processor, the system memory including a semantic model of a combined sewer system that includes specification information with respect to components of the combined sewer system to accumulate knowledge of components within the combined sewer system, the system memory also including a monitoring and alerting (MA) engine that is configured to:

interrogate an electronic sensor out of a plurality of electronic sensors distributed throughout the components of the combined sewer system to obtain operating parameter information about the components of the combined sewer system sensed by the plurality of electronic sensors;

receive by a plurality of wireless transceivers the operating parameter information sensed by the plurality of electronic sensors distributed throughout the components of the combined sewer system;

analyze the operating parameter information received from the plurality of sensors together with the specification information in the semantic model of the combined sewer system to determine if a combined sewer overflow (CSO) event is possible;

model relationships among entities which includes the components of the combined sewer system, the plurality of electronic sensors, and the plurality of wireless transceivers, so that each entity is modeled with respect to other entities;

display a pictorial image of the combined sewer system for selecting components of the combined sewer system to receive a current operating parameter information for a selected component;

generate an alert to provide a notification of a possible CSO event if the MA engine determines that a CSO event is possible; and actuate an actuator node to operate valves within the combined sewer system to prevent the CSO event by providing temporary storage.

2. The MA IHS of claim 1, wherein a component of the combined sewer system is a main pipe in which a weir is situated, the main pipe handling both wastewater and stormwater, the weir exhibiting a weir height that the semantic model stores as specification information.

3. The MA IHS of claim 2, wherein the specification information includes respective pipe diameter information for the main pipe, for the wastewater pipes and for stormwater pipes that connect to the main pipe in the sewer system.

4. The MA IHS of claim 3, wherein the MA engine receives wet weather information and dry weather information to enable the MA engine to determine if a possible CSO event is a dry weather or wet weather CSO event.

5. The MA IHS of claim 4, wherein in response to a determination that a CSO event is possible, the MA engine instructs a buffer storage to temporarily store wastewater and stormwater to prevent the wastewater and stormwater from overtopping the weir and causing a CSO event, and the interrogation of the electronic sensor occurs frequently for the electronic sensor that senses operating parameter information which is determined to be important, and the entities within the semantic model exhibit inheritance to inherit from equipment within the combined sewer system.

6. The MA IHS of claim 1, wherein the specification information includes respective pipe diameter information for a main pipe, wastewater pipes and stormwater pipes that connect to the main pipe in the sewer system.

7. The MA IHS of claim 6, wherein the MA engine receives wet weather information and dry weather information to enable the MA engine to determine if the possible CSO event is a dry weather or wet weather CSO event.

8. The MA IHS of claim 7, wherein in response to the determination that the CSO event is possible, the MA engine instructs a buffer storage to temporarily store wastewater and stormwater to prevent the wastewater and stormwater from overtopping a weir and causing a CSO event.

9. The MA computer program product of claim 8, further comprising ninth instructions that receive wet weather information and dry weather information to enable a determination of whether the possible CSO event is a dry weather or wet weather CSO event.

10. The MA computer program product of claim 9, further comprising tenth instructions wherein in response to a determination that a CSO event is possible the sixth instructions instruct a buffer storage to temporarily store wastewater and stormwater to prevent the wastewater and stormwater from overtopping a weir and causing a CSO event, and the interrogation of the electronic sensor occurs frequently for the electronic sensor that senses operating parameter information which is determined to be important, and the semantic model indicates that equipment in the combined sewer system is connected to other pieces of equipment within the combined sewer system.

11. A monitoring and alert (MA) computer program product, comprising: a non-transitory computer readable storage medium;

first instructions that access a semantic model of a combined sewer system that includes specification information with respect to components of the combined sewer system to accumulate knowledge of components within the combined sewer system;

second instructions to interrogate a sensor out of a plurality of sensors distributed throughout the components of the combined sewer system to obtain operating parameter information about the components of the combined sewer system sensed by the plurality of sensors;

third instructions that receive from communication nodes through wired connections operating parameter information sensed by the plurality of sensors distributed throughout the components of the combined sewer system;

fourth instructions that analyze the operating parameter information received from the plurality of sensors together with the specification information in the semantic model of the combined sewer system to determine if a combined sewer overflow (CSO) event is possible;

fifth instructions to model relationships among entities which includes the components of the combined sewer system, the plurality of electronic sensors, and the plurality of wireless transceivers, so that each entity is modeled with respect to other entities;

sixth instructions to display a pictorial image of the combined sewer system for selecting components of the combined sewer system to receive a current operating parameter information for a selected component;

seventh instructions that generate an alert to provide a notification of a possible CSO event if the MA engine determines that a CSO event is possible;

eighth instructions to actuate an actuator node to operate valves within the combined sewer system to prevent the CSO event by providing temporary storage, wherein the first through eighth instructions are stored on the non-transitory computer readable storage medium.

12. The MA computer program product of claim 11, wherein a component of the combined sewer system is a main pipe in which a weir is situated, the main pipe handling both wastewater and stormwater, the weir exhibiting a weir height that the semantic model stores as specification information.

13. The MA computer program product of claim 12, wherein the specification information includes respective pipe diameter information for the main pipe, for the wastewater pipes and for stormwater pipes that connect to the main pipe in the sewer system.

14. The MA computer program product of claim 13, further comprising fifth instructions that receive wet weather information and dry weather information to enable a determination of whether the possible CSO event is a dry weather or wet weather CSO event.

15. The MA computer program product of claim 14, further comprising sixth instructions wherein in response to a determination that a CSO event is possible the sixth instructions instruct a buffer storage to temporarily store wastewater and stormwater to prevent the wastewater and stormwater from overtopping the weir and causing a CSO event.

* * * * *